US006959458B1

(12) United States Patent
Tsai

(10) Patent No.: US 6,959,458 B1
(45) Date of Patent: Nov. 1, 2005

(54) TOILET SEAT WITH LIQUID IN MULTIPLE SECTIONS FOR DECORATIVE EFFECT

(76) Inventor: Jui-An Tsai, 11F, No. 143, Kuo-Sheng 1st Street, Tao-Yuan City (TW)

( * ) Notice: Subject to any disclaimer, the term of this patent is extended or adjusted under 35 U.S.C. 154(b) by 0 days.

(21) Appl. No.: 11/053,419

(22) Filed: Feb. 9, 2005

(51) Int. Cl.[7] ..... A47K 13/00
(52) U.S. Cl. ..... 4/234; 4/237
(58) Field of Search ..... 4/229, 234, 235, 4/237–239, 242.1, 661

(56) References Cited

U.S. PATENT DOCUMENTS 5,432,956 A * 7/1995 Park ..... 4/239
6,370,704 B1 * 4/2002 White, Jr. ..... 4/237

* cited by examiner

*Primary Examiner*—Tuan Nguyen
(74) *Attorney, Agent, or Firm*—Dennison, Schultz, Dougherty & MacDonald

(57) ABSTRACT

A toilet seat with decorative effect includes a toilet lid as well as a circular seat with a plurality of isolated sections. Each of the isolated section forms a transparent closed space for accommodating liquid or ornaments with different colors such as single-liquid with lustrous foil fragments or dual-liquid with floats so as to achieve a colorful decorative effect. Thus no matter the toilet lid or the circular seat is lifted up or put down, the isolated sections with liquid and ornament have decorative effects. The toilet seat can also match the interior design of the whole bathroom.

9 Claims, 7 Drawing Sheets

TOILET SEAT WITH LIQUID IN MULTIPLE SECTIONS FOR DECORATIVE EFFECT

BACKGROUND OF THE INVENTION

The present invention relates to a toilet seat with decorative effect, especially to a toilet seat having a seat and a cover that produces a decorative effect by a plurality of isolated sections. Each of the isolated section forms a transparent closed space (room) for accommodating liquid or ornaments with different colors so as to achieve a colorful decorative effect.

Generally a toilet seat in bathroom is composed by a toilet lid and a circular seat that are linked with each other by a pivot. Due to large area of the surface of the seat cover, no matter it's lifted up or down, the toilet lid (seat cover) becomes the focal point (draws your attention). It have great effect on users feelings for bathrooms. Most of conventional toilet seats are made by plastic injection molding. Only the shapes or colors of toilet seats can be changed due to limitation of the function. Thus the toilet seat and lid are difficult to match the design of the whole bathroom for the sake of aesthetics. Moreover, liquid ornaments are prior arts, including single-liquid type and dual-liquid type. The single-liquid type has only a single liquid such as transparent kerosene or water inside a container with various ornaments such as lustrous foil fragments therein. While the dual-liquid type has two kind of liquid, insoluble to each other, such as transparent kerosene and dyed water and some ornaments may be put in the interface between the two liquids. A lot of convenience goods such as lotion bottles, cups, trash cans, brushes or computer mouse are added with ornaments by the way mentioned above in order to increase the novelty of the appearance. A transparent space is disposed on the enclosure of the devices for being filled with liquid and ornaments. However, only part of or single area of the device has limited effect on the improvement of the appearance. If the whole toilet seat has only a single space therein, it's difficult to manufacture the closed space by ultrasonic welding processing due to the large area thereof. Moreover, a single space can be disposed with only one or two kind so liquid thus it's still monotonous.

SUMMARY OF THE INVENTION

Therefore it is a primary object of the present invention to provide a toilet seat with liquid in multiple sections for decorative effect. The area on the toilet lid or the circular seat is divided up into several small, isolated sections, each of which is a transparent closed space for accommodating liquid with various colors. Thus no matter the toilet seat or lid is lifted up or put down, they have colorful decorative effect. The toilet seat can also match the interior design of the whole bathroom.

It is another object of the present invention to provide a toilet seat with liquid in multiple sections for decorative effect. The toilet lid or circular seat is composed by an upper and a lower transparent shells made by plastic injection molding. The upper shell has an intermediate space with a plurality of isolated plate therein for dividing the toilet lid or circular seat into a plurality of section. While a plurality of connecting slot is disposed on the lower shell, corresponding to the position of the isolated plates on the upper shell for being connected with the isolated plates by ultrasonic welding so that the upper shell and the lower shell are connected with each other and a plurality of isolated transparent closed space is formed. Each of the closed space has a pore for filling liquid so as to fill various liquid and ornaments into the closed space. Therefore, the present invention is easy to be manufactured in large amount with reduced cost.

It is further object of the present invention to provide a toilet seat with liquid in multiple sections for decorative effect. The isolated sections therein is designed with various figures according to users favorites so as to increase the decorative effect and interests of toilet seats.

BRIEF DESCRIPTION OF THE DRAWINGS

The above features of the present invention will become more apparent from the following description of the preferred embodiments given in conjunction with the accompanying drawings.

DETAILED DESCRIPTION OF THE PREFERRED EMBODIMENT

Figure 1:
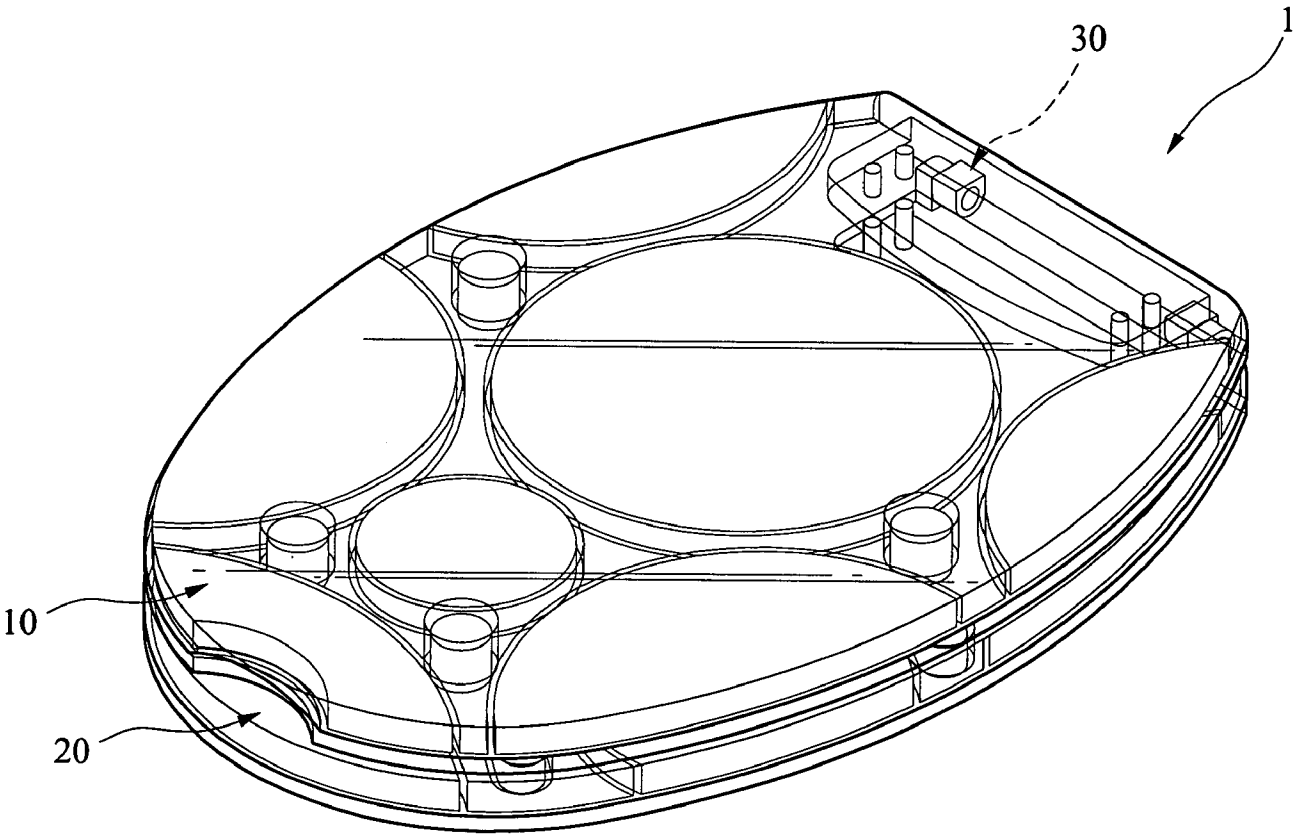
FIG. 1 is a perspective view of an embodiment in accordance with the present invention.
Figure 2:
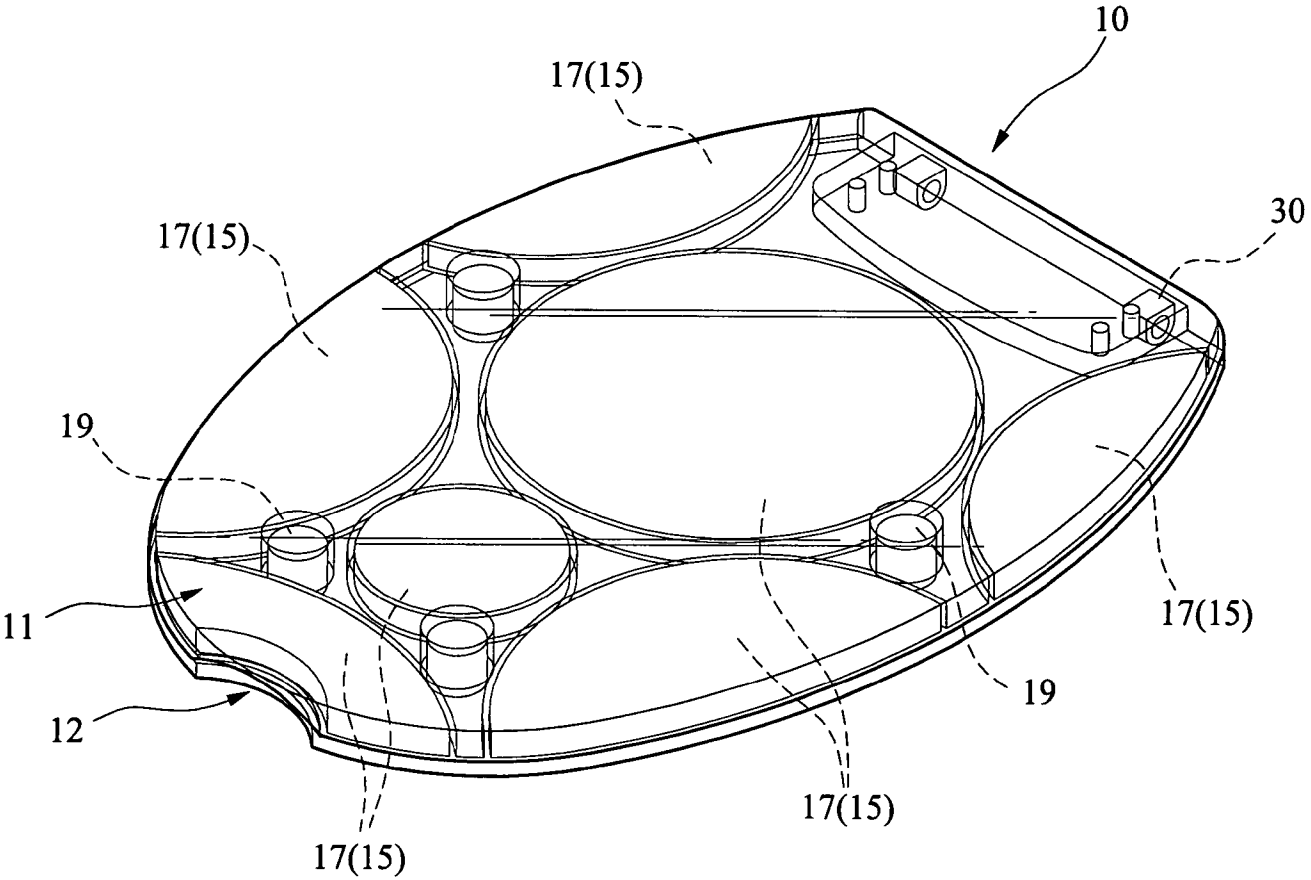
FIG. 2 is a perspective view of a toilet lid of the embodiment in FIG. 1.
Figure 3:
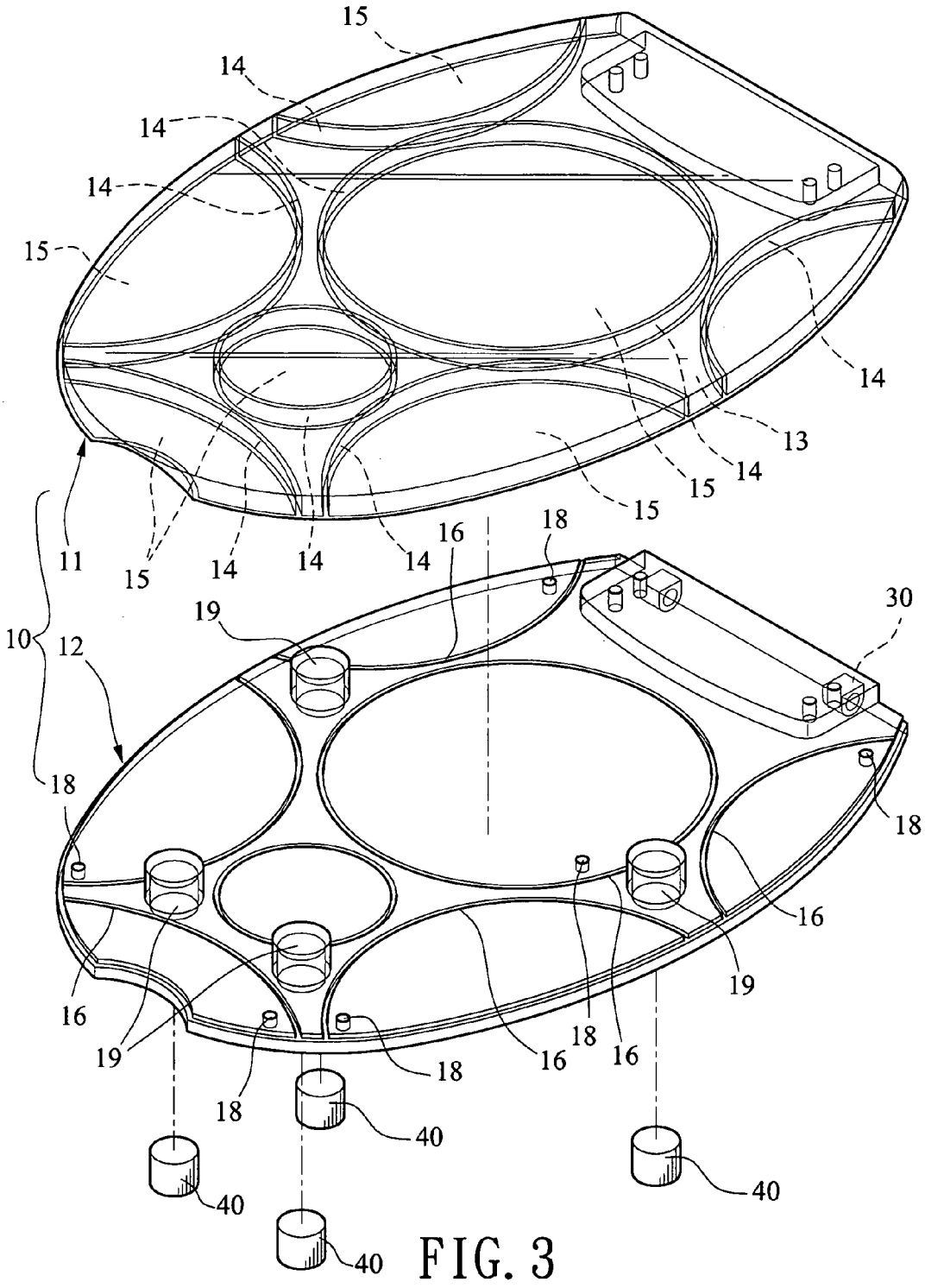
FIG. 3 is an explosive view of the toilet lid of the embodiment in FIG. 2.
Figure 4:
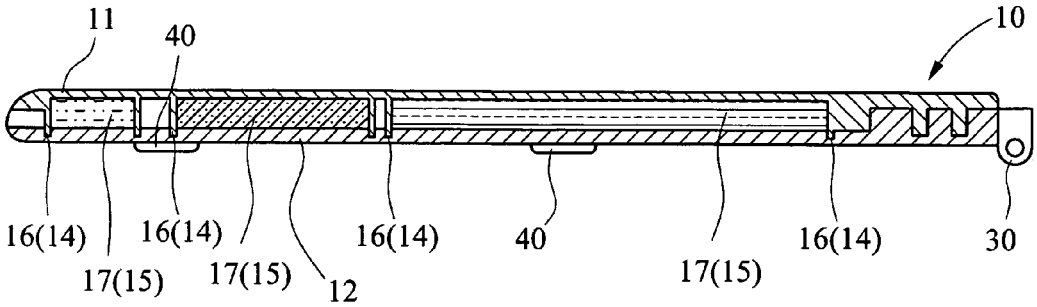
FIG. 4 is a cross-sectional view of the toilet lid of the embodiment in FIG. 2.

Refer to FIG. 1, a toilet seat 1 in accordance with the present invention consists of a toilet lid 10 and a circular seat 20. A pivot structure 30 is disposed between the toilet lid 10 and the circular seat 20 for connecting each other and installation on the toilet. The toilet lid 10 and the circular seat 20 can be lifted up or put down respectively. The pivot structure 30 is a prior art and it can be designed into different types.

Figure 5:
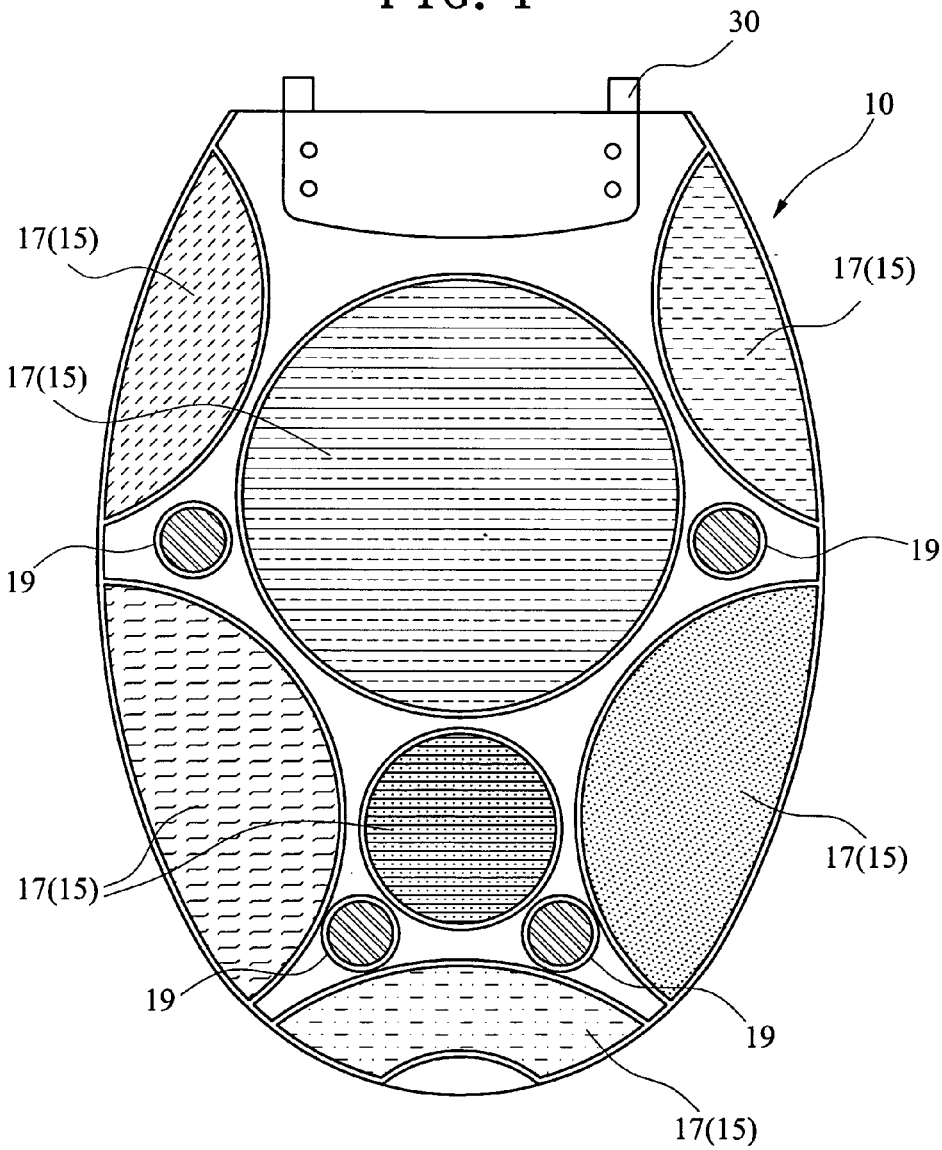
FIG. 5 is a schematic drawing showing liquids with various colors are filled into the toilet lid of the embodiment in FIG. 2.
Figure 6:
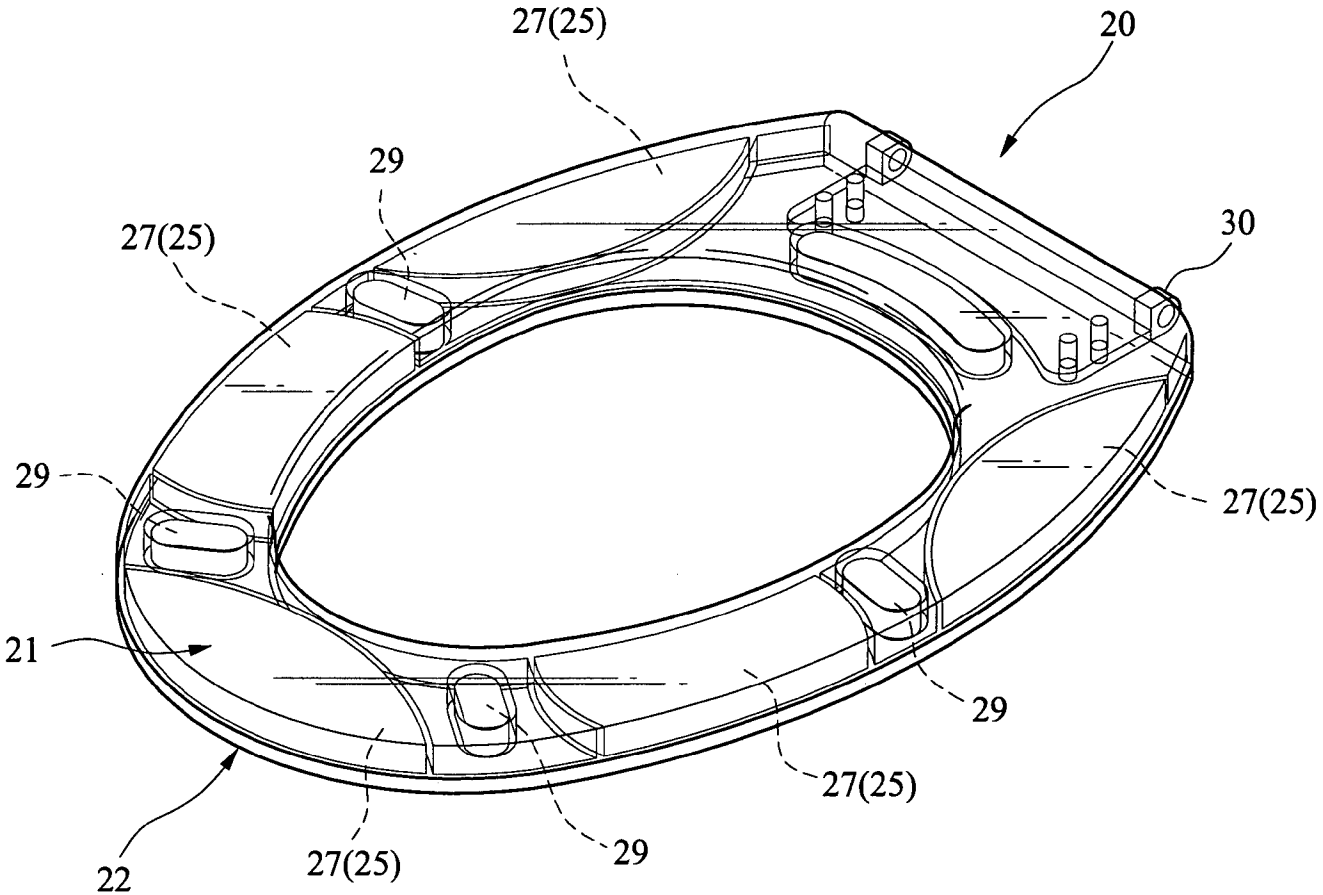
FIG. 6 is a perspective view of a circular toilet seat of the embodiment in FIG. 1.
Figure 7:
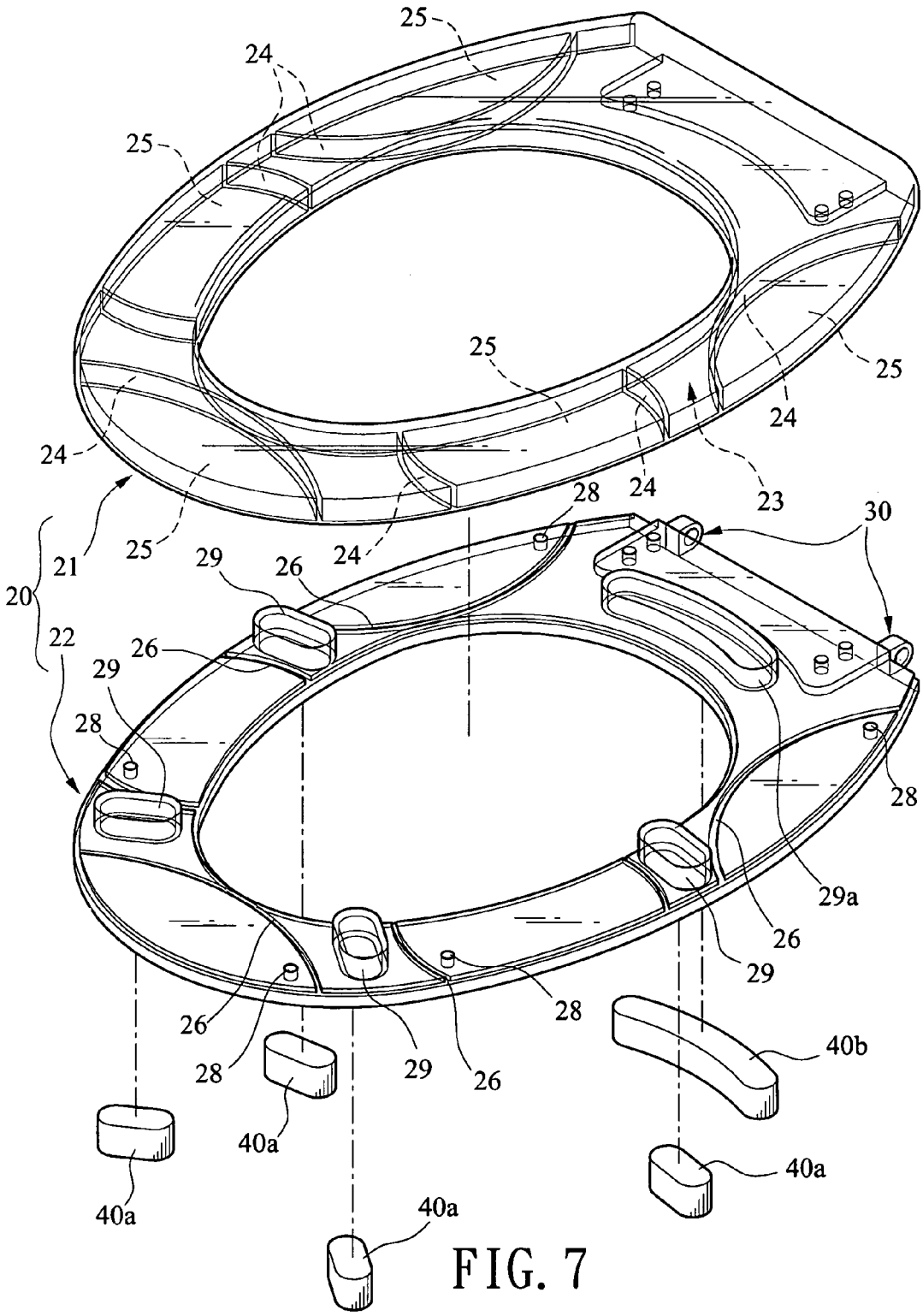
FIG. 7 is an explosive view of the circular toilet seat of the embodiment in FIG. 6.
Figure 8:
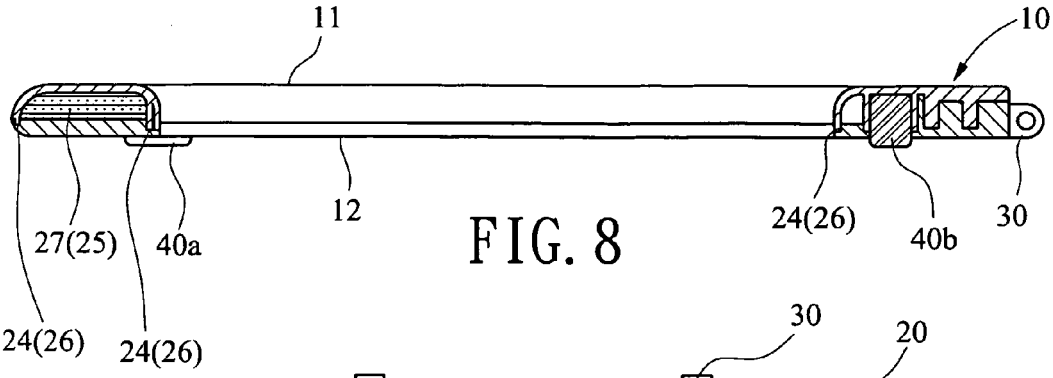
FIG. 8 is a cross-sectional view of the circular toilet seat of the embodiment in FIG. 6.

The design of multiple sections can be applied to the toilet lid 10 and the circular seat 20 respectively or both. Refer to FIG. 1, FIG. 2, FIG. 3 & FIG. 4, the toilet lid 10 consists of a transparent upper shell 11 and a transparent lower shell 12, each is made by plastic injection molding respectively. An intermediate space 13 is inside the upper shell 11 with a plurality of perpendicular arranged projective isolated plate 14 so as to divide the intermediate space 13 into a plurality of section 15. Moreover, the isolated plates 14 can be linear or arched without limitations so that the various sections 15 may have different shapes and boundaries, depending on users needs. The lower shell 12 is a plate, corresponding to the upper shell 11. A plurality of connecting slot 16 is disposed on the lower shell 12, corresponding to the position of the isolated plates 14 on the upper shell 11 for being connected with the isolated plates 14 by ultrasonic welding. The upper shell 11 and the lower shell 12 are connected with each other by ultrasonic welding to form the toilet lid 10 and each of the isolated sections 15 forms a closed space 17 with certain depth. Each of the closed space 17 having a pore for filling liquid 18 that is mounted on the lower shell 12. When being manufactured, various ornaments such as lustrous foil fragments or floats are disposed inside each of the isolated sections 15 before the ultrasonic welding. After being welded, single liquid such as transparent kerosene or water, or dual liquid insoluble to each other such as transparent kerosene and dyed water is/are filled into each of the isolated closed space 17 through each of the pore for filling liquid 18. No matter the toilet lid 10 is lifted up or put down, the ornaments and liquids inside the closed space 17 will have decorative effect, as shown in FIG. 5, each symbol inside different sections means a kind of liquid.

Figure 9:
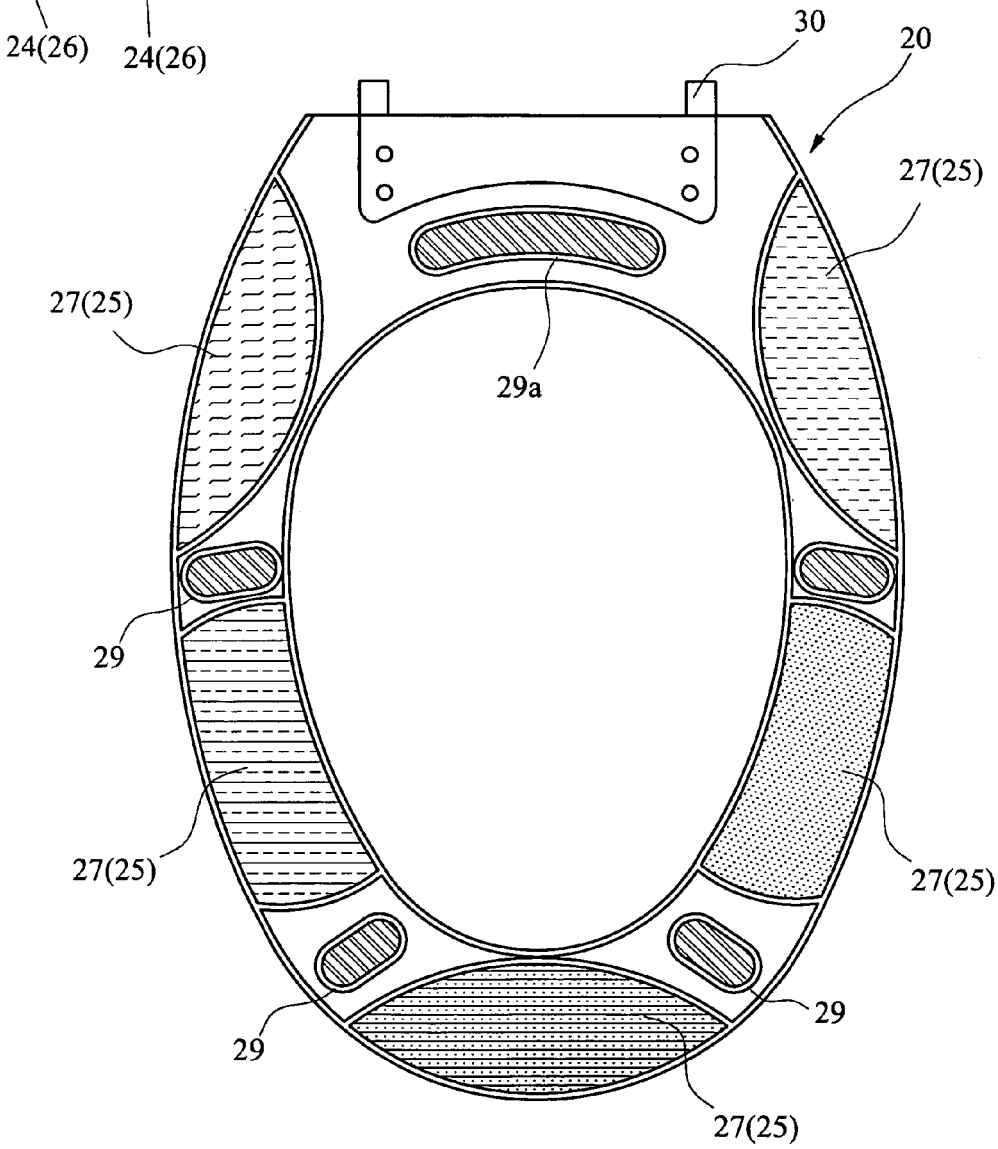
FIG. 9 is a schematic drawing showing liquids with various colors are filled into the circular toilet seat of the embodiment in FIG. 6.

Refer to FIG. 1, FIG. 6, FIG. 7, FIG. 8, & FIG. 9, the circular toilet seat 20 is composed by a transparent upper shell 21 and a transparent lower shell 22, each is made by plastic injection molding respectively. The upper shell 21 has an intermediate space 23 with a plurality of isolated plate 24 disposed therein so as to divide the intermediate space 23 into a plurality of section 25. There is no limit in the length and shape of each of the isolated plate 24 and so does each of the isolated sections 25. The lower shell 22 is a plate with the shape corresponding to the upper shell 21 and having a plurality of connecting slot 26 for ultrasonic welding, corresponding to the isolated plate 24 on the upper shell 21. The upper shell 21 and the lower shell 22 are assembled with each other by processing of ultrasonic welding to form the circular toilet seat 20 and thus each of the isolated sections 25 forms a closed space 27 with certain depth. Moreover, a pore for filling liquid 28 is arranged on each of the closed space 27, located at the lower shell 22. The assembling procedure of the circular toilet seat 20 is similar with that of the toilet lid 10. Whether the circular toilet seat 20 is lifted up or put down, various liquids and ornaments inside the closed space 27 show colorful and multi-sectional decorative effect, as shown in FIG. 9, each symbol inside different sections means a kind of liquid.

A plurality of bumper block 40, 40*a*, 40*b* is disposed on the bottom of the toilet lid 10. When the toilet lid 10 is put on the circular seat 20, the bumper blocks 40, 40*a*, 40*b* forms a distance therebetween for the convenience of the users. There is also a plurality of bumper block on the bottom of the circular seat for supporting and easy operation. The bumper blocks are made of elastic rubber blocks. Refer to FIG. 2, FIG. 3, FIG. 4, FIG. 6, FIG. 7 & FIG. 8, a plurality of mounting slot 19, 29, 29*a*, corresponding to the location of the bumper block, is arranged on the bottom of the lower shells 12, 22 of the toilet lid 10 and the circular seat 20. The positions of the mounting slots 19, 29, 29*a* have no contact with the isolated plates 14, 24 or connecting slots 16, 26 and the height of the mounting slots 19, 29, 29*a* is less than that of the closed spaces 17, 27. There is no limit of the shape of the mounting slots 19, 29, 29*a*. The bumper blocks 40, 40*a*, 40*b* with corresponding shapes are mounted inside the mounting slots 19, 29, 29*a* respectively. The material of the bumper blocks 40, 40*a*, 40*b* can be elastic rubber.

While the present invention has been described above in conjunction with specific preferred embodiments, it is evident that numerous alternatives, modifications and variations will be apparent to those skilled in the art without departing from the scope of the present invention. Thus, the breadth and scope of the present invention should not be limited by any of the above-described exemplary embodiments, but should be defined only in accordance with the following claims and their equivalents.

What is claimed is:

1. A toilet seat with liquid in multiple sections for decorative effect comprising a toilet lid and a circular seat, connected with each other and disposed on a toilet by a pivot structure; the toilet seat is characterized in that:

the toilet lid or the circular seat having a transparent upper shell and a transparent lower shell, made by plastic injection molding respectively; wherein the upper shell has an intermediate space with a plurality of isolated plates disposed therein so as to divide the intermediate space into a plurality of isolated sections; the lower shell is a plate with the shape corresponding to the upper shell and having a plurality of connecting slots for ultrasonic welding, corresponding to the isolated plate on the upper shell; the upper shell and the lower shell are assembled with each other by processing of ultrasonic welding to form the toilet lid or the circular toilet seat and thus each of the isolated sections forms a closed space for accommodating liquids and ornaments.

2. The device according to claim 1, wherein said isolated plates are in different linear shapes so that the sections have different shapes and boundaries.

3. The device according to claim 1, wherein a pore for filling liquid is disposed on each of the closed space.

4. The device according to claim 3, wherein the pore for filling liquid is mounted on the lower shell.

5. The device according to claim 1, wherein the liquid and ornaments accommodated inside the isolated closed space are a single liquid comprising transparent kerosene or water and ornaments comprising lustrous foil fragments in the liquid.

6. The device according to claim 1, wherein the liquid and ornaments accommodated inside the isolated closed space are a dual-liquid having two kind of liquid insoluble to each other comprising transparent kerosene and dyed water and floats put in the interface between the two liquid.

7. The device according to claim 1, wherein a plurality of mounting slots for mounting bumper blocks is arranged on the bottom of the lower shell.

8. The device according to claim 7, wherein the positions of the mounting slots have no contact with the isolated plates or the connecting slots.

9. The device according to claim 7, wherein the positions of the mounting slots have no contact with the isolated plates or the connecting slots.

* * * * *